US006560882B1

(12) United States Patent
Gwon

(10) Patent No.: US 6,560,882 B1
(45) Date of Patent: May 13, 2003

(54) HAND DRAWING MACHINE

(76) Inventor: Lay Gwon, 25-19 14th Pl., Astoria, NY (US) 11102

( * ) Notice: Subject to any disclaimer, the term of this patent is extended or adjusted under 35 U.S.C. 154(b) by 0 days.

(21) Appl. No.: 10/092,218

(22) Filed: Mar. 7, 2002

(51) Int. Cl.[7] ..... B43L 13/10
(52) U.S. Cl. ..... 33/23.01; 33/23.05
(58) Field of Search ..... 33/23.01, 23.02, 33/23.05, 23.06, 23.08, 25.1, 25.2, 27.12, 18.1

(56) References Cited

U.S. PATENT DOCUMENTS

| | | | | | |
|---|---|---|---|---|---|
| 36,212 | A | * | 8/1862 | Getz | 33/25.1 |
| 548,327 | A | * | 10/1895 | Russell et al. | 33/23.05 |
| 612,339 | A | | 10/1898 | Hearing | |
| 841,223 | A | * | 1/1907 | Bronner | 33/23.05 |
| 1,247,044 | A | * | 11/1917 | Watzelhan | 156/514 |
| 1,320,321 | A | | 10/1919 | Crowley, Jr. | |
| 1,611,690 | A | * | 12/1926 | Solary | 33/23.05 |
| 2,185,011 | A | | 12/1939 | Anderson | |
| 2,588,757 | A | | 3/1952 | Peeples, Jr. | |
| 2,796,665 | A | | 6/1957 | Cossock | |
| 3,154,855 | A | * | 11/1964 | Pelton | 33/18.1 |
| 3,483,622 | A | | 12/1969 | Forster | |
| 3,530,589 | A | | 9/1970 | Kelsey | |
| 3,721,008 | A | | 3/1973 | Frank | |
| 3,775,852 | A | * | 12/1973 | Sandin | 33/23.05 |
| 3,786,567 | A | | 1/1974 | Dangay et al. | |
| 3,831,575 | A | | 8/1974 | Menghini | |
| 3,956,828 | A | | 5/1976 | Kloweit | |
| 4,507,869 | A | | 4/1985 | Stude | |
| 4,733,473 | A | * | 3/1988 | Goldfarb | 33/23.05 |
| 4,945,643 | A | | 8/1990 | Goldfarb | |
| 5,279,039 | A | * | 1/1994 | Anderson et al. | 33/21.2 |
| 5,562,452 | A | * | 10/1996 | Atugi et al. | 434/85 |

* cited by examiner

*Primary Examiner*—Diego Gutierrez
*Assistant Examiner*—Amy R. Cohen
(74) *Attorney, Agent, or Firm*—Richard C. Litman

(57) ABSTRACT

A hand drawing machine which includes two spring-loaded spools. Each spool includes a length of flexible material, and each length of material is attached to a rigid stick or rod. The stick, which may be adjustable, includes a pair of stylus holders. The stylus holders can hold a marker or a tracing pin. Each of the spools has a gear portion that meshes with the other gear portion of the other spool. When a marker or tracing pin is moved a corresponding movement is made by the marker in the other stylus holder. The machine allows for the tracing of an image or for simultaneously drawing two copies of an image.

7 Claims, 4 Drawing Sheets

HAND DRAWING MACHINE

BACKGROUND OF THE INVENTION

1. Field of the Invention

The present invention relates to a hand drawing machine for reproducing a planar image.

2. Description of the Related Art

Devices for hand tracing a planar image exist. The best-known device is tracing paper which requires the user to place they tracing paper over the image and draw directly on the tracing paper. The primary disadvantage of tracing paper is that the paper itself is not of high quality and is very flimsy so that the resulting picture is of unsuitable, poor quality. Mechanical devices also exist for reproducing a planar image. These devices are typically difficult to use because of their limited range of movement, and their unstable construction. Likewise, either the mechanical devices of the prior art cannot change the dimensions of the planar image, or they can only enlarge or shrink the image but not both. Additionally, the prior art devices that permit the enlargement or shrinkage of the image unavoidably distort the image.

U.S. Pat. No. 1,320,321 issued to Crowley, Jr. on Oct. 28, 1919 discloses a planigraph which is utilized to copy pictures, designs and other planar images. The planigraph has a fixed arm and a movable arm; the movable arm is utilized to reproduce an image but only moves relative to the fixed arm; therefore, the invention of Crowley changes the dimensions of the original image and distorts the image by either elongating or widening it. U.S. Pat. No. 3,721,008 issued to Frank on Mar. 20, 1973 describes a device (a marker and tracking arm) which is a pen with an arm extending therefrom having a tracking point that follows an identical track as the point of the pen. The invention of Frank produces an image of the same dimensions as the image traced but is inherently unstable. U.S. Pat. No. 4,945,643 issued to Goldfarb on Aug. 7, 1990 shows an amusement apparatus for drawing a distorted caricature by tracing an original photograph or other planar image; the apparatus enlarges the image in one direction, but copies without enlargement in an orthogonal direction. The invention of Goldfarb has a tracing arm which has a tracing stylus at one point, a drawing-implement holder at another point, and a longitudinal track along another part of the arm; the track engages a pivot that in effect resolves all tracing motions into radial components without size change and rotary components with size changes. None of these inventions have the qualities of the present invention in total; either they distort the image or are not designed for detailed tracing.

U.S. Pat. No. 3,786,567 issued to Dangay, deceased et al. on Jan. 22, 1974 shows an apparatus for drawing the isometric perspective view of an object. The apparatus has a fixed support on which the flat view of the object is provided, a rotatable support for a drawing sheet and positionable in one of three positions spaced 120°, a follower for following a flat view, a tracer displaceable over the rotatable support and means linking the follower and tracer such that displacements of the follower in two perpendicular directions cause displacements of the tracer that are perpendicular but in the ratio of one over the square root of three, the linkage means for displacements in one reference direction comprising rotary means, the effective diameters of which are in the ratio of one over the square root of three. The invention of Dangay facilitates the hand drawing of an isometric perspective view of an object, it does not change the dimensions of the object nor does it depict the same view. Also, the invention of Dangay is much more complicated than the current invention, having been conceived for a distinctive utility which is inherently different from the present invention.

U.S. Pat. No. 3,483,622 issued to Forster on Dec. 16, 1969 discloses a drawing apparatus which is designed for the production of stereoscopic images. The drawing apparatus has a drawing mechanism attached to a drawing board having a pliable support with two rollers, a plate to guide the support, and a guide rail to guide the supports. The drawing apparatus of Forster reproduces a second image while the user is drawing a first image such that the first and second image are slightly different in order to create the illusion of three dimensions. The invention of Forster is not suited for the purpose of the present invention and has no means provided for changing the size of a copied image.

In an analogous technique, wood carving machines exist which are designed to reproduce an image in wood. These devices may have parallel arms having a tracing stylus on one arm and a cutting implement on another. U.S. Pat. No. 2,185,011 issued to Anderson on Jun. 30, 1938 shows a wood carving machine which is adapted for carving individual facsimiles of any particular work pattern that the user may desire to copy. U.S. Pat. No. 3,831,575 issued to Menghini on Aug. 27, 1974 discloses a semi-automatic apparatus for reproducing relief images on solid bodies which has a sensing member and a working tool member; the sensing member traces the three-dimensional image and the working tool member reproduces the image. Wood carving devices are not appropriate for tracing images onto paper as they are designed to reproduce a three dimensional image.

U.S. Pat. No. 612,339 issued to Hearing on Oct. 11, 1898, U.S. Pat. No. 2,588,757, issued to Peeples, Jr. on Nov. 21, 1949, U.S. Pat. No. 2,796,665 issued to Cossock on Jul. 26, 1955, U.S. Pat. No. 3,956,828 issued to Kloweit on May 18, 1976, U.S. Pat. No. 4,507,869 issued to Stude on Apr. 2, 1985 teach marking devices. However, none teach gears or tensioning means for controlling the markers. Further the gears of U.S. Pat. No. 3,530,589 issued to Kelsey on Sep. 29, 1970 are for a different purpose than those of the instant invention and are not spring-loaded.

None of the above inventions and patents, taken either singularly or in combination, is seen to describe the instant invention as claimed. Thus, a hand drawing machine solving the aforementioned problems is desired.

SUMMARY OF THE INVENTION

The present invention is a hand drawing machine which includes two spring-loaded spools. Each spool includes a length of flexible material, and each length of material is attached to a rigid stick or rod. The stick, which may be adjustable, includes a pair of stylus holders. The stylus holders can hold a marker or a tracing pin. Each of the spools has a gear portion that meshes with the other gear portion of the other spool. When a marker or tracing pin is moved a corresponding movement is made by the marker in the other stylus holder.

Accordingly, it is a principal object of the invention tog reproduce a planar image by hand. The invention allows a user tog trace a planar image such as a photograph, drawing or similar image easily. The invention is designed to permit very detailed reproduction of the planar image allowing accurate depiction of the finest details.

It is another object of the invention to eliminate distortions when copying an image by hand. The present invention facilitates making a copy of a planar image without distortions in either the width or height of the image copied if desired.

It is a further object of the invention to provide a hand drawing machine which is a sturdy device that is not wobbly. The construction of the present invention is sturdy, and does not shake or otherwise reduce the quality of the image reproduced. The sturdiness of the apparatus allows the user to make intricate tracings of a planar image.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a hand drawing machine 10 which is used to copy a planar image by hand onto a piece of paper or other suitable flat material. The hand drawing machine 10, as discussed in greater detail hereinafter, has a first stylus holder 12 and a second stylus holder 14 which function as a tracing stylus holder and a marking stylus holder respectively. The tracing stylus holder is designed to grip a tracing stylus which is guided over the original planar image to trace the image. The tracing stylus may be a needle or any other suitable pointing instrument. The marking stylus holder grips a marking stylus which may be a pen, a pencil, or other implement that can be used to mark a planar image on a suitable material. Reversing the location of the tracing stylus and the marking stylus is possible. Likewise, the tracing stylus may be replaced by a marking stylus permitting the creation of two complementary planar images simultaneously. Also, the styluses may be identical differing only in their function. The tracing stylus holder 12 is in mechanical communication with the marking stylus holder 14 through the assembly, such that any movement of the tracing stylus holder reproduces a corresponding movement in the marking stylus holder.

Figure 1:
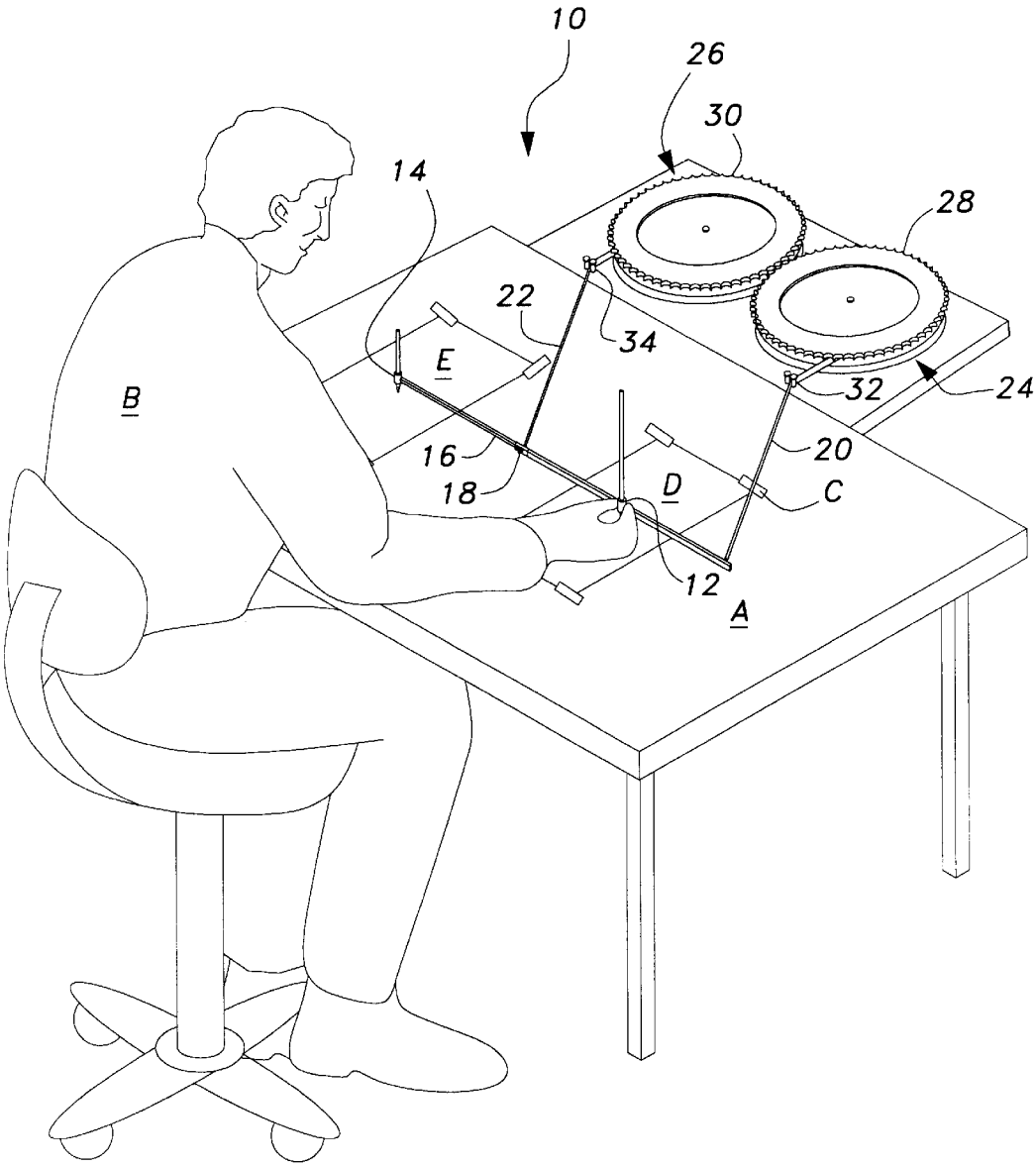
FIG. 1 is an environmental, perspective view of a hand drawing machine according to the present invention.

FIG. 1 shows an environmental view of the hand drawing machine 10. A user B is shown using the present invention. The planar image D to be traced and the blank paper E are shown removably affixed to the table A by tape C. Other conventional means of affixing the planar image D and the paper E to the table A, which may have an extension for holding the machine 10, are also contemplated. For example, paper clips may be used to hold the planar image and paper in place.

The stylus holders 12, 14 are located on a rigid member, i.e. a rod or a stick, 16. The rigid member 16 can be extended and has an extension or locking member 18. The stylus holders 12, 14 are located on opposite sides of the extension member 18, such that the extension of the rigid member 16 results in the movement of the Styluses with respect to each other. This ability to vary the distance between the tracing stylus 12 and the marking stylus 14 is important to accommodate for different distances between planar image D and the paper E. Additionally, being able to adjust the length of the rigid member 16 is aids in storing and transporting the machine 10.

The rigid member 16 is connected to a pair of flexible tapes 20, 22, which are similar to tape measures. However, it is noted that any type of material that works in the present invention can be used. Each of the tapes 20, 22 is attached at its opposite end to a spring-loaded spool 24, 26.

As the tracing stylus 12 is used and pulled farther away from the spool 24, the length of the flexible tape 20 extending from the spool 24 becomes greater. As the tracing stylus 12 becomes closer to the spool 24 the tape 20 is pulled back onto the spool 24 because it is spring loaded.

The spool 24 rotates to take in or let out the tape 20. Because a portion of the spool 24 is a gear 28, which is meshed with gear 30 on spool 26, the rotation of spool 24 results in the rotation of spool 26. The rotation of spool 26 will adjust the length of tape 22 and make the marking stylus holder 14 move in unison with the tracing stylus holder 12. The tape 20 is guided through a pair of guide pins 32, and the tape 22 is guided through a pair of guide pins 34.

Figure 2A:
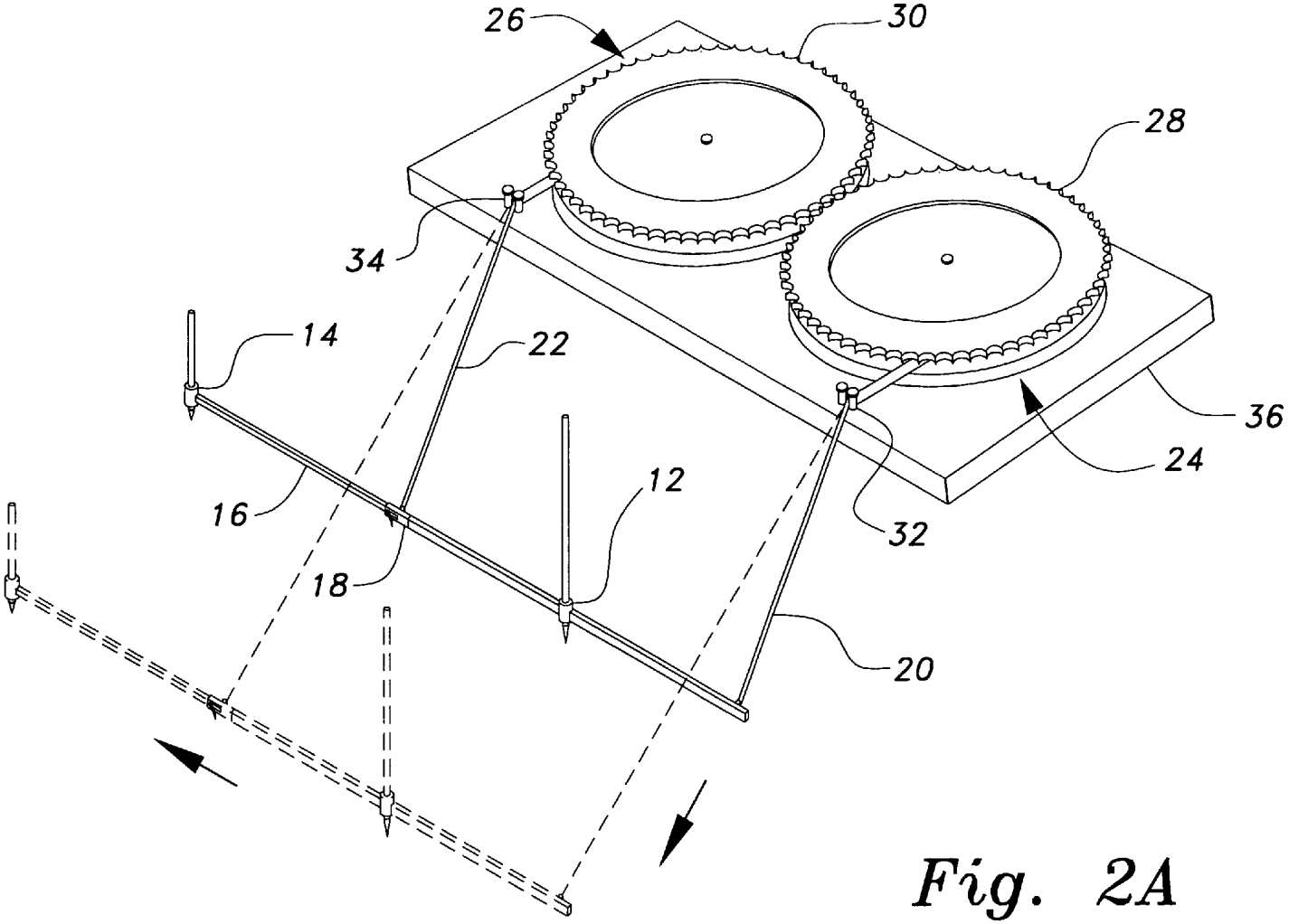
FIG. 2A is a perspective view in which the movement of the machine is shown.
Figure 2B:
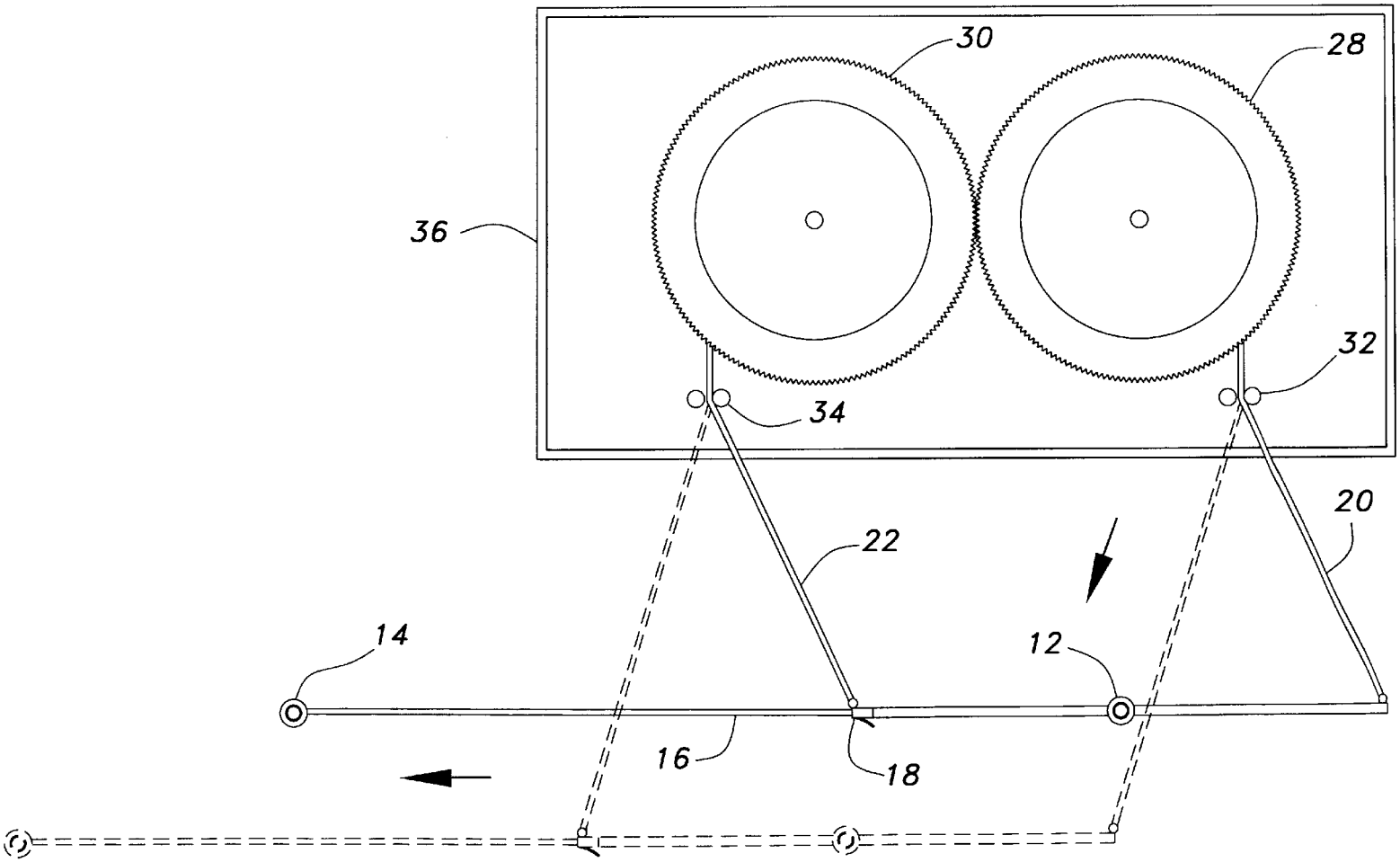
FIG. 2B is a top plan view in which the movement of the machine is shown.
Figure 3:
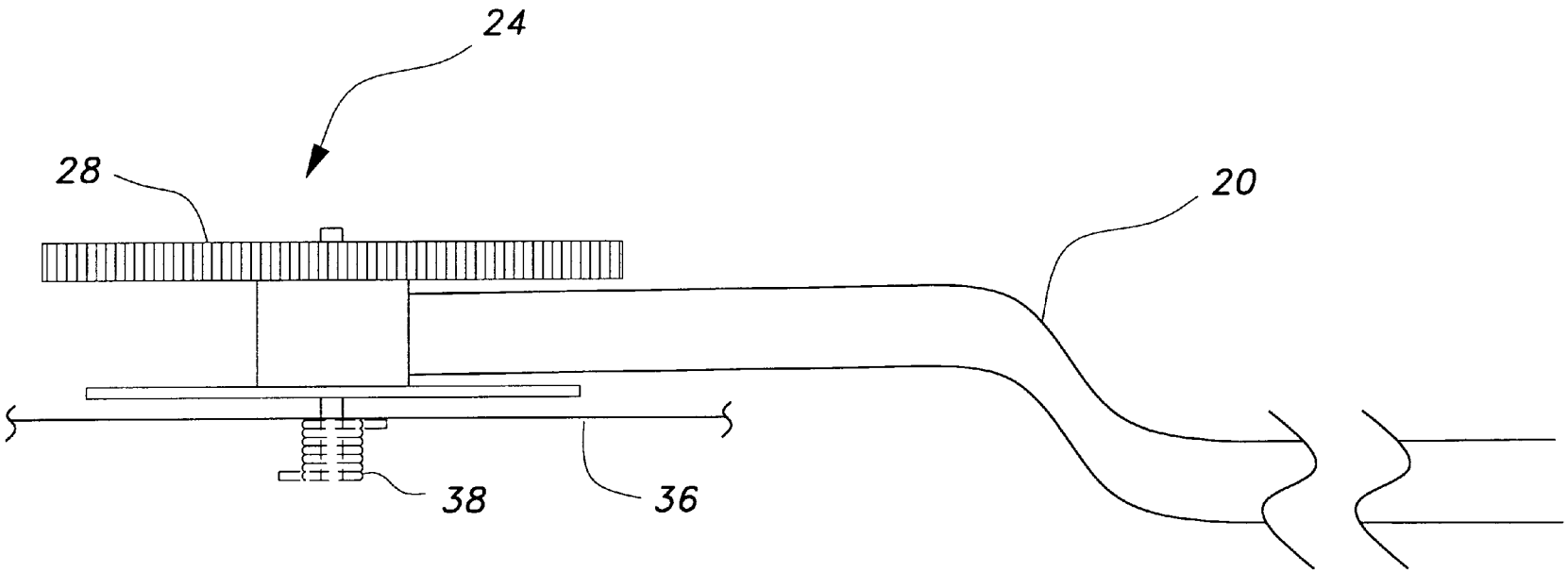
FIG. 3 is a side elevational view of the machine.

It further noted that the machine can include its own mounting board or it can be part of a drafting table. In FIG. 1 the machine is shown as part of a drafting table extension. In FIGS. 2A, 2B, and 3 it is shown with its own mounting board 36. FIG. 3 shows the side view with the spring 38. This side view shows they detail of the spool 24. The spool 26 is identical and has the same type of spring to make it spring loaded.

It is to be understood that the present invention is not limited to the embodiments described above, but encompasses any and all embodiments within the scope of the following claims.

I claim:

1. A hand drawing machine comprising:

a first spring-loaded spool and a second spring-loaded spool rotatably mounted on a board, each said spool including a gear portion, each said gear portion in meshed communication with said gear portion on the other spool;

an elongated flexible material attached to each said spool at a first end of said material; and a rigid member attached to a second end of each of said material, said rigid member including two stylus holders; wherein the movement of a stylus or a tracing pin in one of said stylus holders causes a corresponding movement of a stylus in the other of said stylus holders.

2. The machine of claim 1 further including guide members located along a length of each of said material.

3. The machine of claim 1 wherein said rigid member has an extension and one of said stylus holders is located on said extension, such that the adjustment of said extension causes the distance between each said stylus holder to vary.

4. The machine of claim 1 wherein said material is a cloth tape.

5. A hand drawing machine comprising:

a board;

two spring-loaded spools rotatably mounted to said board, each of said spools including a gear portion and an attached length off material, each said gear portion is in meshed communication with the other said gear portion;

a rigid member attached to each said length of material at an end opposite that attached to each said spool, said rigid member including two stylus holders; and guide members located on said table along a length of said material between the attachment to each said spool and the attachment to said rigid member; wherein the movement of a stylus or a tracing pin in one of said stylus holders causes a corresponding movement of a stylus in the other of said stylus holders.

6. The machine of claim 5 wherein said rigid member has an extension and one of said stylus holders is located on said extension, such that the adjustment of said extension causes the distance between each said stylus holder to vary.

7. The machine of claim 5 wherein said material is a cloth tape.

* * * * *